US006508157B1

(12) United States Patent
Brown

(10) Patent No.: US 6,508,157 B1
(45) Date of Patent: Jan. 21, 2003

(54) TOOL FOR UNBLOCKING HEAVY MACHINERY

(76) Inventor: James S. Brown, 1773 North Damon, Simi Valley, CA (US) 93063

( * ) Notice: Subject to any disclaimer, the term of this patent is extended or adjusted under 35 U.S.C. 154(b) by 0 days.

(21) Appl. No.: 10/086,971

(22) Filed: Mar. 4, 2002

(51) Int. Cl.[7] ..... F41F 5/00
(52) U.S. Cl. ..... 89/1.14
(58) Field of Search ..... 89/1.14; 102/530

(56) References Cited

U.S. PATENT DOCUMENTS 144,843 A * 11/1873 Goldsmith et al. ..... 134/17
3,353,445 A * 11/1967 Temple et al. ..... 102/531
3,910,494 A * 10/1975 Melton, Jr. ..... 239/13
4,239,004 A * 12/1980 Day et al. ..... 102/202.13
4,423,682 A * 1/1984 Schimmel ..... 102/275.2
4,664,033 A * 5/1987 Burkdoll et al. ..... 102/275.11
5,082,502 A * 1/1992 Lee et al. ..... 134/1
5,115,708 A * 5/1992 Spariat et al. ..... 102/378
5,279,227 A * 1/1994 Nishizawa ..... 102/274

* cited by examiner

*Primary Examiner*—Charles T. Jordan
*Assistant Examiner*—Jordan M Lofdahl
(74) *Attorney, Agent, or Firm*—Elliott N. Kramsky

(57) ABSTRACT

A tool for dislodging lubrication-blocking debris from machinery elements. A housing includes a forward internal chamber. An adapter receives an explosive charge element and completes the chamber. The adapter includes an exteriorly-threaded portion for affixation of the tool to a lubrication access hole. A firing mechanism is positioned and spring loaded at a rear chamber of the housing. In use, the tool is inserted in place of a grease nipple and the explosive charge element detonated, for example, by striking the exposed end of the firing mechanism with as a hammer. A pulse of pressurized gases is thereby generated to clear the blocked lubrication passage.

11 Claims, 4 Drawing Sheets

TOOL FOR UNBLOCKING HEAVY MACHINERY

BACKGROUND

1. Field of the Invention

The present invention relates to heavy machinery such as that employed for earthmoving and related uses. More particularly, this invention pertains to a tool for unclogging material residues that can block operation and increase wear significantly.

2. Description of the Prior Art

Heavy equipment, such as that employed for earthmoving functions, requires constant lubrication to assure successful long term operation. Such equipment is often operated in environments that are extremely hostile over time. Moving parts and assemblies must be protected from the intrusion of dirt and sand that, over time, can cause excessive wear, requiring often-premature replacement.

FIG. 1 is an exploded perspective view of a portion of an assembly of the above type, a swing post 10 for a tractor. Such a device, mounted to the rear of the tractor includes an assembly of elements of the type that require regular lubrication to maintain operations that require motion with respect to contacting elements. Representative elements commonly found in heavy machinery include, for example, pins 12, bushings 14, washers 16 and snap rings 18. These elements are gather into subassemblies as shown that are received within accommodating apertures 20 of a casting 22 to thereby enable mechanical motion with respect to such casting 22.

All of the above-described representative parts are commonly of metal, often steel. Bushings 14 are generally provided to prevent rotational movement directly between the pins 12 and the apertures 20 of the casting 22. In use, it is essential that lubrication be regularly delivered to prevent excessive wear from occurring between the pins 12, bushings 14 and apertures 20 of the casting 22. This requires the provision of access for the tip of a grease gun. Lubrication access holes may be found in all of such parts and their proper location will, of course depend upon the precise arrangement of the elements of the equipment. Access holes 24 located within the casting 22 and pins 12 are illustrated in FIG. 1. Associated with each of such holes 24 is a grease nipple 26 that acts as a cap to minimize the intrusion of dirt into mechanisms. Such nipples 26 are provided for coupling to a grease gun to facilitate lubrication of a pin 12.

Even when a maintenance program of regular lubrication is adhered to, the accumulation of dirt between moving surfaces is unavoidable in equipment, such as that for earth moving, due to the hostile environment and the presence of minute clearances between moving parts. This can lead to the freezing of the relationship between parts that can require replacement and disassembly resulting in considerable cost and down time. Such freezing may also result from non-use of equipment for extended periods of time during which existing lubrication may become hardened.

SUMMARY OF THE INVENTION

The present invention addresses the preceding and other shortcomings of the prior art by providing a tool for dislodging material from the interior of a machine element. Such tool includes an elongated housing having opposed ends. An elongated firing mechanism is also provided.

The housing has a rear chamber for receiving the firing mechanism. An adapter includes a rear portion for coupling to the housing and a forward portion for coupling to the machinery. The adapter has an interior chamber which receives an explosive charge element. The chamber is continuous therethrough.

An explosive charge element is provided. The housing has a forward chamber for registering the firing pins and the explosive charge element so that force applied to the firing pins is transmitted to the charge element.

The preceding and other features of this invention shall become further apparent from the detailed description that follows. Such description is accompanied by a set of drawing figures. Numerals of the drawing figures, corresponding to those of the written description, point to the features of the invention. Like numerals refer to like features throughout both the written text and the drawing figures.

DETAILED DESCRIPTION OF THE PREFERRED EMBODIMENT

Figure 1:
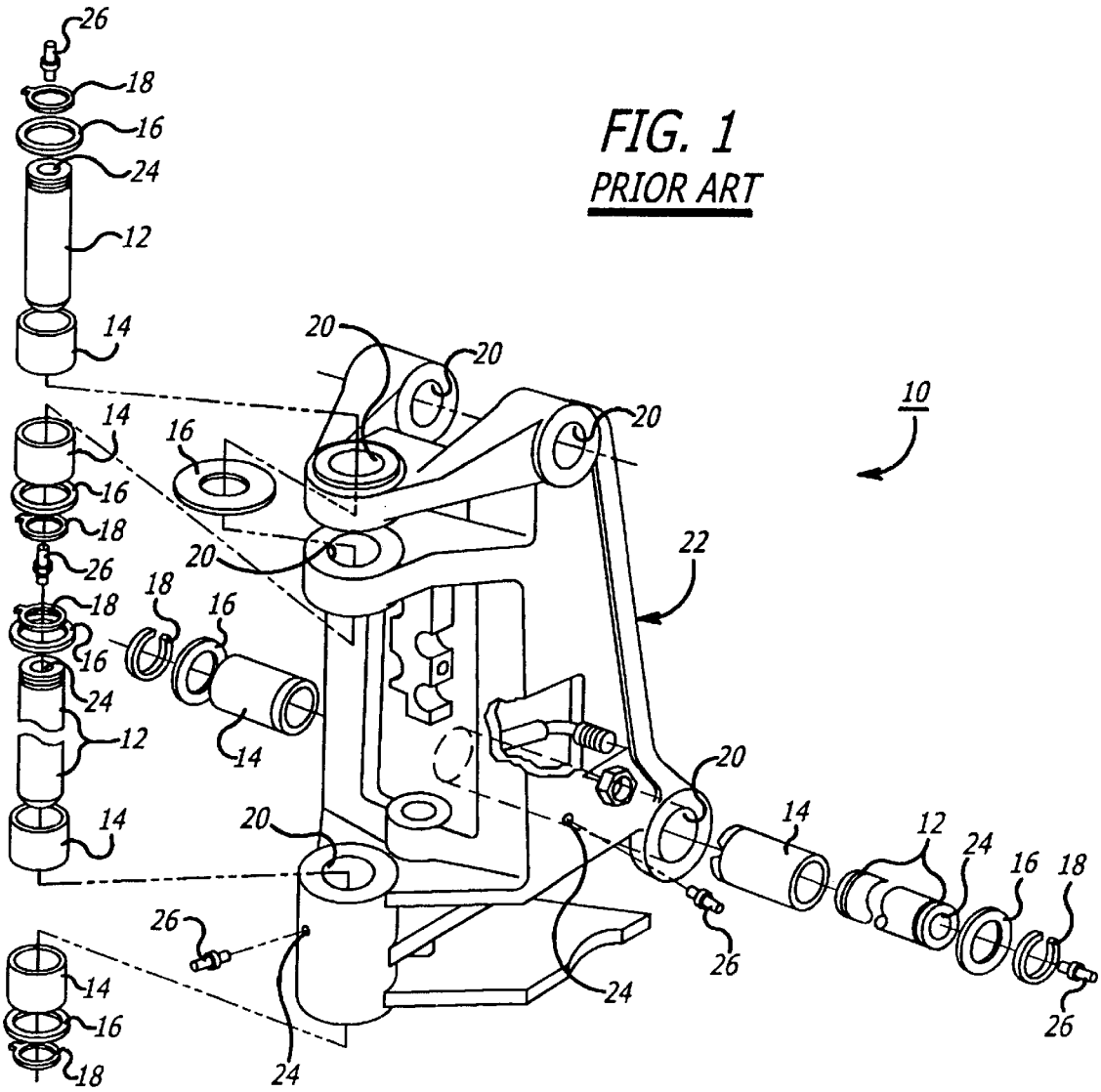
FIG. 1 PRIOR ART
FIG. 1 is an exploded perspective view of a portion of a swing post assembly for a tractor.
Figure 2:
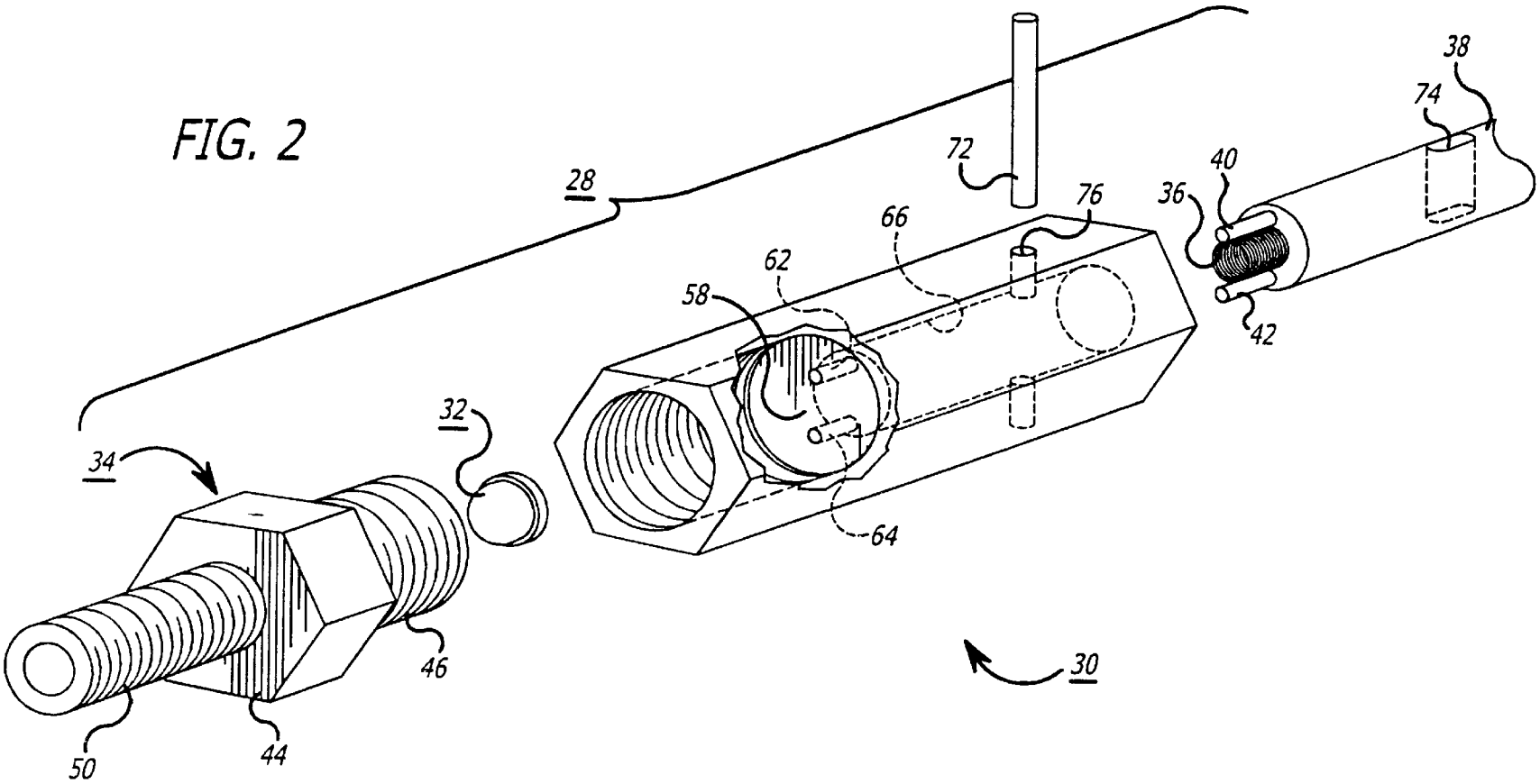
FIG. 2 is an exploded perspective view of a debris removal tool in accordance with the invention.

Turning to the drawings, FIG. 2 is an exploded perspective view of a debris removal tool 28 in accordance with the invention. The tool 28, which is adapted to be inserted into a hole 24 of a pin 12, casting 22 or the like that receives lubrication, removes mechanism-clogging debris. The tool 28 includes a housing 30 for actuating an explosive charge element 32 that is received within an adapter 34. The adapter 34 accommodates and positions the tool 28 with respect to a clogged or frozen machinery element. A spring 36 provides a return force for a firing mechanism 38 to lift firing pins 40 and 42 of the mechanism 38 out of the way for safe loading of the explosive charge element 32.

Figure 4:
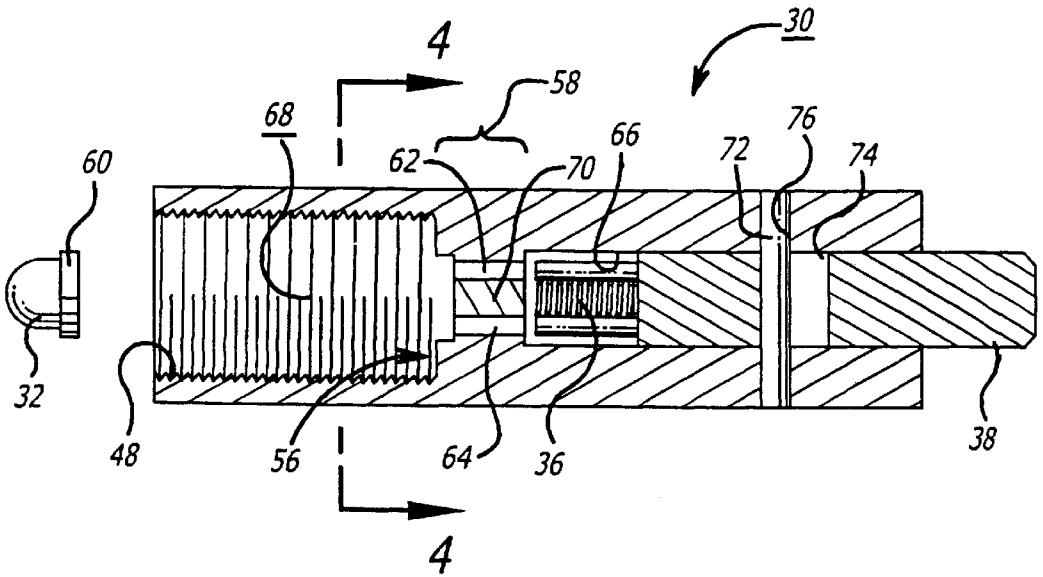
FIG. 4 is a frontal plan view of the housing of the debris removal tool of the invention taken at line 4—4 of FIG. 3.
Figure 4:
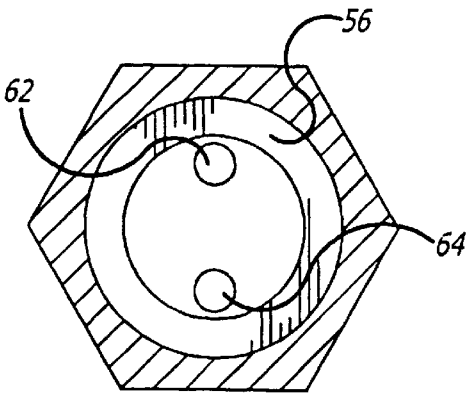
Figure 3:
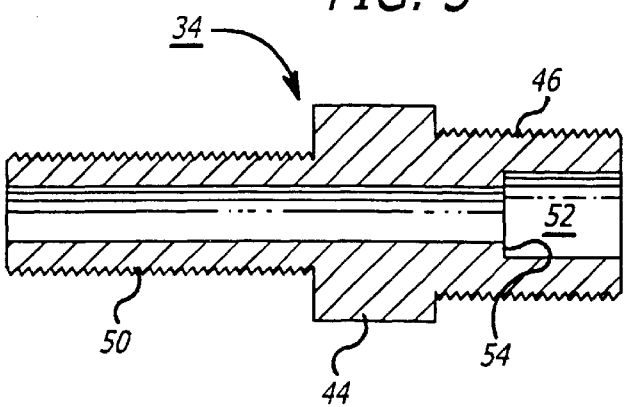
FIG. 3 is a side elevation view, in cross section of the debris removal tool of the invention.

FIG. 3 is a side elevation view in cross-section of a partially-assembled tool 28 in accordance with the invention and FIG. 4 is a front cross-sectional view of the housing of the tool taken at line 4—4 of FIG. 3. Referring to FIGS. 2, 3 and 4 in combination, the adapter 34 is an integral machined piece that includes a central hex nut 44 that separates a first outwardly-threaded member 46 for engaging an inwardly-threaded portion 48 of the housing 30 from a second outwardly-threaded member 50. The second outwardly-threaded member 50 is provided for engaging the tool 28 to a lubrication access hole of either a pin or a casting as described above. Such engagement of the tool 28 for use is illustrated in, and will be described with reference to, FIGS. 5(*a*) and 5(*b*) below.

An axial internal channel 52 is formed within the adapter 34 for admitting a flow of highly-pressurized gases, resulting from combustion of the explosive charge element 32, through the adapter 34 and into the lubrication access hole into which the tool 28 has been fitted. As can be seen in FIG. 3, the channel 52 narrows at an internal shoulder 54 that separates an enlarged rear portion into which the explosive charge element 32 is seated from a narrower front channel portion that is compatible with the diameter of the second exteriorly-threaded member 50.

An annular ridge 56 at the front of a bulk-head 58 surrounds and thereby positions the base 60 of the explosive charge element 32. The explosive charge element 32 is preferably of the rim-actuated type. That is, ignition of the charge element 32 requires that the force of the firing mechanism 38 be transmitted near its circumference for detonation. Diametrically-opposed channels 62, 64 allow the access of the paired firing pins 40, 42 through the bulk-head 58 that separates a rear channel 66 of the housing 30 for receiving the elongated firing mechanism 38 from an enlarged forward channel 68 of the housing 30.

As mentioned earlier, the firing mechanism is loaded for reuse by means of the spring 36. Energy stored in the spring 36 under compression creates a force that urges the firing mechanism 38 away from a central pedestal 70 within the bulk-head 58 (see FIG. 3). The position of the firing mechanism 38 is maintained within the housing 30 through the cooperative action of a pin 72 and a slot 74 in the side of the firing mechanism 38. The pin 72 enters the housing 30 through radial aperture 76. The coaction of the pin 72 with the slot 74 under the force exerted by the spring 36 assures that the firing mechanism 38 is positioned with the leftmost portion of the slot 74 aligned with the radial aperture 76.

Figure 5A:
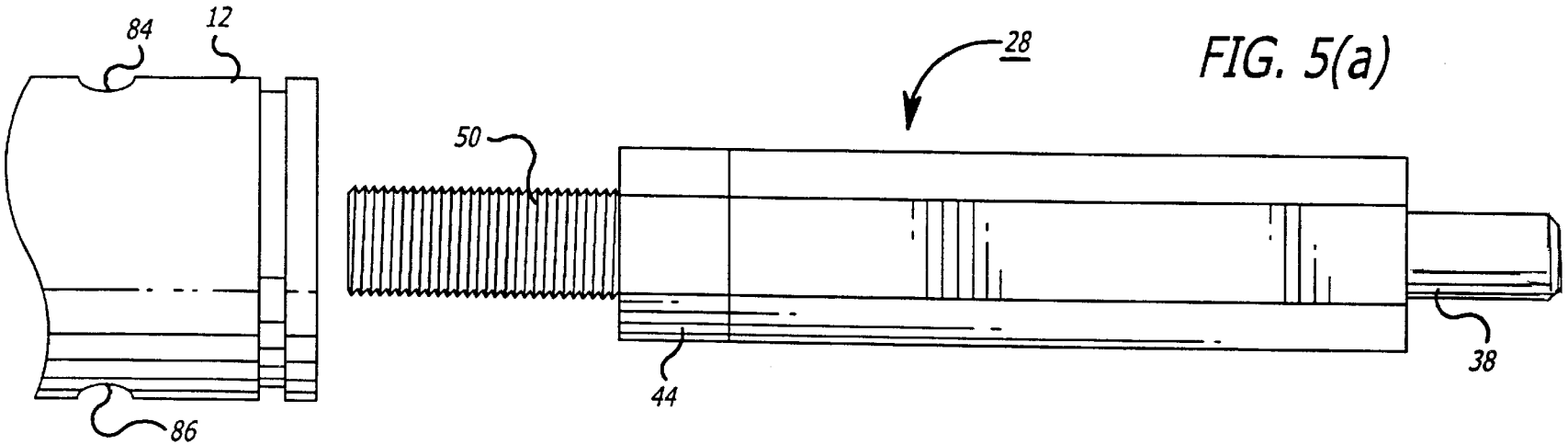
FIGS. 5(*a*) and 5(*b*) are side elevation views of the debris removal tool of the invention for illustrating its relationship and affixation to a pin for use.
Figure 5B:
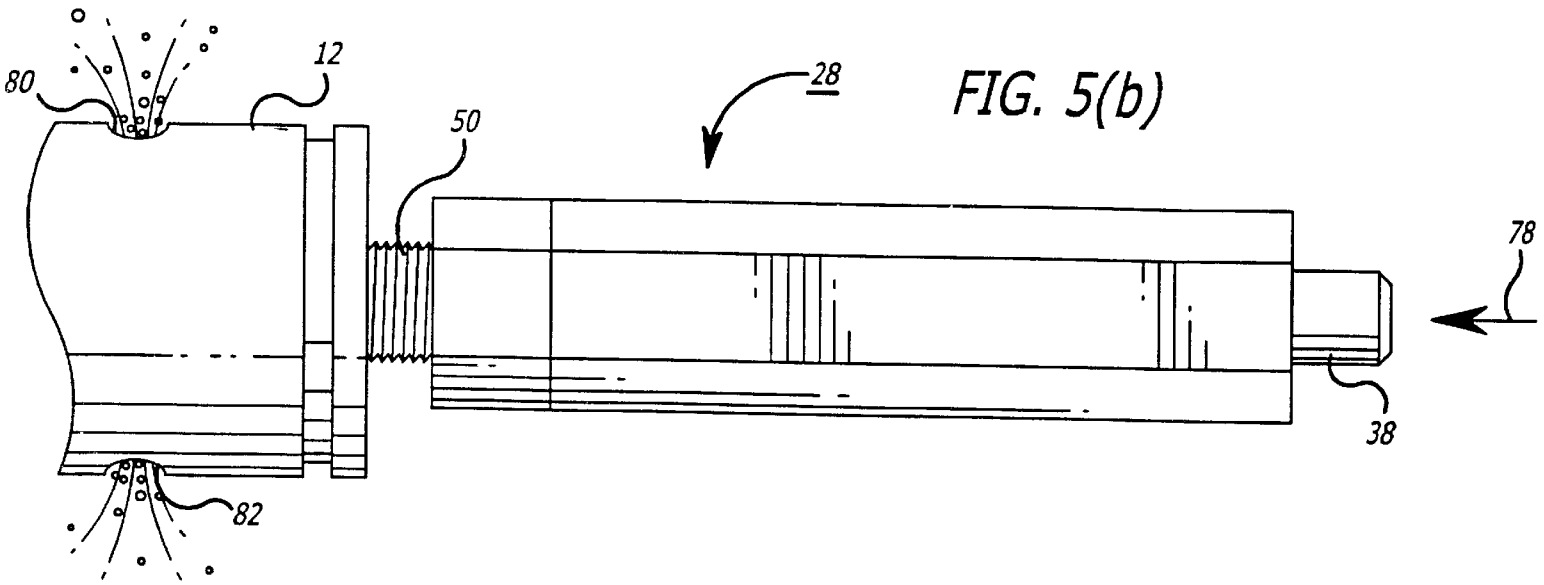

FIGS. 5(*a*) and 5(*b*) are side elevation views of the fully-assembled tool 28 adapted for use. In particular, the tool 28 is shown as it is adapted for clearing an accumulation of debris, such as sand and dirt, from the interface of a pin 12 and a surrounding bushing (not shown) that have clogged the clearance space therebetween and thereby prevented machine operation. In FIG. 5(*a*), the tool 28 is spaced from and facing the lubrication access hole (not shown) at the end of the pin 12 (after removal of an associated grease nipple) with the second exteriorly-threaded member of the adapter 34 adjacent the hole and the firing mechanism 38 end of the tool 28 remote therefrom.

FIG. 5(*b*) illustrates (i) the insertion of the tool 28 at the second exteriorly-threaded member of the adapter 34 and (ii) the detonation of the charge element 32 that results from the forced travel of the firing mechanism as indicated by the arrow 78 to thereby cause the blockages that prevent lubrication by clogging the pin's lubrication flow holes 80, 82 to be cleared by the resultant rush of gases from the tool 28 through the channel 52 within the adapter 34. The necessary force to urge the firing mechanism 38 and firing pins 40 and 42 against the explosive charge element 32 to cause detonation can be provided by swinging a hammer and does not require any special skills or abilities. As mentioned. once the explosive charge element 32 has been detonated to clear the flow holes 80, 82, the spring 36 will urge the firing mechanism 38 away from the bulkhead 58. The tool 28 may then be unscrewed at the second outwardly-threaded member 50 of the adapter 34, the adapter unscrewed from the housing 30, the spent explosive charge element 32 removed, a new charge element placed within the channel 52, and the adapter 34 screwed into the housing 30. The tool 28 is then recharged and ready for reuse (i.e., insertion of the adapter 34 into a lubrication access hole).

Thus it is seen that the present invention provides a tool for unclogging machinery of the type in which lubrication flow paths are provided between coactive members. By clearing such paths from periodic clogging, one may be assured that regular lubrication is provided during the lifetime of the machinery, resulting is lower maintenance costs and longer effective equipment life.

While this invention has been illustrated with reference to its presently-preferred embodiment, it is not limited thereto. Rather, this invention is limited only insofar as it is defined by the following set of patent claims and includes within its scope all equivalents thereof.

What is claimed is:

1. A tool for removal of debris from the interior of a machinery element comprising, in combination:

a) an elongated, substantially hollow housing having opposed ends;

b) an elongated firing mechanism having opposed ends;

c) said housing having a rear internal chamber for receiving said firing mechanism;

d) an adapter including a rear portion for coupling to said housing and a forward portion for coupling to said machinery element;

e) said adapter having an interior chamber therethrough;

f) an explosive charge element; and g) said housing having a forward internal chamber for registering said explosive charge element so that force applied to said firing mechanism is transmitted to said charge element.

2. A tool as defined in claim 1 further including:

a) a spring; and b) said spring is located within said rear chamber and arranged to be compressed by movement of, and to exert a reactive force upon, said firing mechanism.

3. A tool as defined in claim 2 further characterized in that:

a) one end of said firing mechanism is substantially flat;

b) at least one firing pin protrudes from the opposed end of said firing mechanism.

4. A tool as defined in claim 3 wherein said housing further includes an internal bulk-head located between said forward and rear internal chambers.

5. A tool as defined in claim 4 wherein said annular shoulder has at least one tunnel therethrough for admitting passage of said at least one firing pin.

6. A tool as defined in claim 5 further including:

a) said bulk-head having a surface facing said forward internal chamber; and b) said surface including an annular ring for receiving and positioning said explosive charge element.

7. A tool as defined in claim 6 wherein said bulk-head area has at least one channel therethrough for accommodating said at least one firing pin.

8. A tool as defined in claim 5 further including:

a) said firing mechanism being substantially cylindrical;

b) an elongated slot in the side of said firing mechanism; and c) said housing having an inwardly-directed retaining pin; and d) said retaining pin is arranged to be received within said one elongated slot.

9. A tool as defined in claim 1 further characterized in that said adapter further includes a nut between said rear and forward portions.

10. A tool as defined in claim 1 wherein said forward portion of said adapter is exteriorly-threaded.

11. A tool as defined in claim 1 further characterized in that:

a) said rear portion of said adapter is exteriorly threaded; and b) said forward interior chamber of said housing is interiorly threaded for engaging said rear portion of said adapter.

* * * * *